US005419688A

United States Patent [19]

Basinski et al.

[11] Patent Number: 5,419,688

[45] Date of Patent: May 30, 1995

[54] MOUNTING FOR OILLESS AIR COMPRESSOR

[75] Inventors: Edward M. Basinski, Manlius; Richard L. Martin, Cicero, both of N.Y.; M. Wayne Meece; John H. Bolthouse, II, both of Monroe, La.

[73] Assignee: Carrier Corporation, Syracuse, N.Y.

[21] Appl. No.: 267,416

[22] Filed: Jun. 28, 1994

[51] Int. Cl.[6] ..... F04B 17/00

[52] U.S. Cl. ..... 417/423.15; 92/147; 92/150; 92/161

[58] Field of Search ..... 62/295, 297, 78; 92/146, 147, 150, 161, 153, 154; 417/360, 423.15, 361; 99/473, 474, 475, 476; 248/309.1

[56] References Cited

U.S. PATENT DOCUMENTS 1,513,584 10/1924 Cornwall ..... 92/161
5,137,434 8/1992 Wheeler et al. ..... 417/368
5,244,363 9/1993 Olson .
5,332,547 7/1994 Olson et al. ..... 422/3
5,355,781 10/1994 Liston et al. ..... 99/476

*Primary Examiner*—Thomas E. Denion

[57] ABSTRACT

An oilless reciprocating air compressor that is mountable on the inside wall of a cargo container. The compressor has a high strength cast metal crank case and a lighter motor housing attached thereto. A special bracket is provided that attaches to both the crank case and the motor housing to support the motor shaft in a horizontal plane and the opposed cylinders of the compressor in a vertical plane adjacent to the wall. Because this compressor mounted inside the container cooling fans and the like are not required, thus lightening the compressor and allowing for a compact unit that can be safely secured to the cargo container wall.

11 Claims, 2 Drawing Sheets

MOUNTING FOR OILLESS AIR COMPRESSOR

BACKGROUND OF THE INVENTION

This invention relates to an oilless reciprocal compressor that is suitable for mounting on the inside wall of a cargo container and for carrying perishable foodstuffs such as fruits and vegetables.

Cargo containers are typically carried on the open decks of sea going vessels and are thus exposed to a harsh salt air environment. The containers are made generally air tight and the inside environment of the container is maintained at a desired temperature by self-sustaining air conditioning equipment. As many of the components as possible are brought inside the container to protect them from the harsh outside environment. This however, consumes valuable cargo space and it is therefore important to package the equipment to minimize space.

The cargo containers typically undergo rough handling, oftentimes being bumped or dropped from relatively high elevations as they are being loaded and unloaded from carriers. Accordingly, the equipment stored in the container must be securely fastened in place so that it cannot break loose thus endangering the cargo.

In the case of cargo containers used to carry perishable fruits and vegetables, it is highly desirable to replace the oxygen within the container with nitrogen gas which serves to better preserve the perishable foodstuff. To this end, systems have been derived wherein outside air is first compressed and then passes through a series of filters and membranes to separate nitrogen gas from the incoming air. The nitrogen is discharged into the container while the other separated air constituents, including oxygen, are exhausted to ambient.

Small reciprocating air compressors such as the compressor described in U.S. Pat. No. 5,244,363 to Olson possess the operating parameters that are required for use in this type of nitrogen generation system. The prior art compressors, however, have two undesirable features that make them less than attractive for use in this particular application. First, crankcase oil can move past the piston rings and find its way into the compressed air stream. This, in turn, has an adverse effect on downstream filters and separating membranes as well as the products stored in the container. Secondly, reciprocating air compressors that are presently available generally include self contained cooling fans that are space consuming. They also have relatively weak mounting brackets that cannot withstand the rough handling that a cargo container is exposed to and do not lend themselves to wall mounting because of bearing loading considerations.

SUMMARY OF THE INVENTION

It is therefore an object to improve reciprocating air compressors for use in cargo containers.

It is a further object of the present invention to adapt reciprocating air compressor for use in a cargo container.

A still further object of the present invention is to provide a wall mounting arrangement for a reciprocating air compressor so that the compressor can be effectively utilized in a cargo container.

Another object of the present invention is to securely mount a reciprocating air compressor on a vertical side wall of a cargo container in a space saving configuration to avoid thrust loading of the shaft bearing.

These and other objects of the present invention are attained by an oilless reciprocating air compressor having a high strength crank case attached to a lesser strength motor housing. Opposed compression cylinders are mounted on the crank case which contain pistons attached to the motor shaft. The motor housing further contains a mounting plate that is fastened to a bracket for supporting the compressor upon a vertical wall of a cargo container. The bracket is also secured to the crank case to provide an extremely strong and secure mounting arrangement. The bracket is configured so that the compressor can be attached to an inside vertical wall of the container with the motor shaft being horizontally disposed and the opposed cylinders being vertically disposed adjacent to the wall. Because the compressor is exposed to the air conditioned atmosphere inside the container it does not require its own cooling fan. This, coupled with the wall mounting arrangement, allows for a compact space saving configuration that is really suited for use in a cargo container.

BRIEF DESCRIPTION OF THE DRAWINGS

For a better understanding of these and other objects of the present invention reference will be made to the following detailed description of the invention which is to be read in association with the accompanying drawings wherein.

DESCRIPTION OF THE INVENTION

Figure 1:
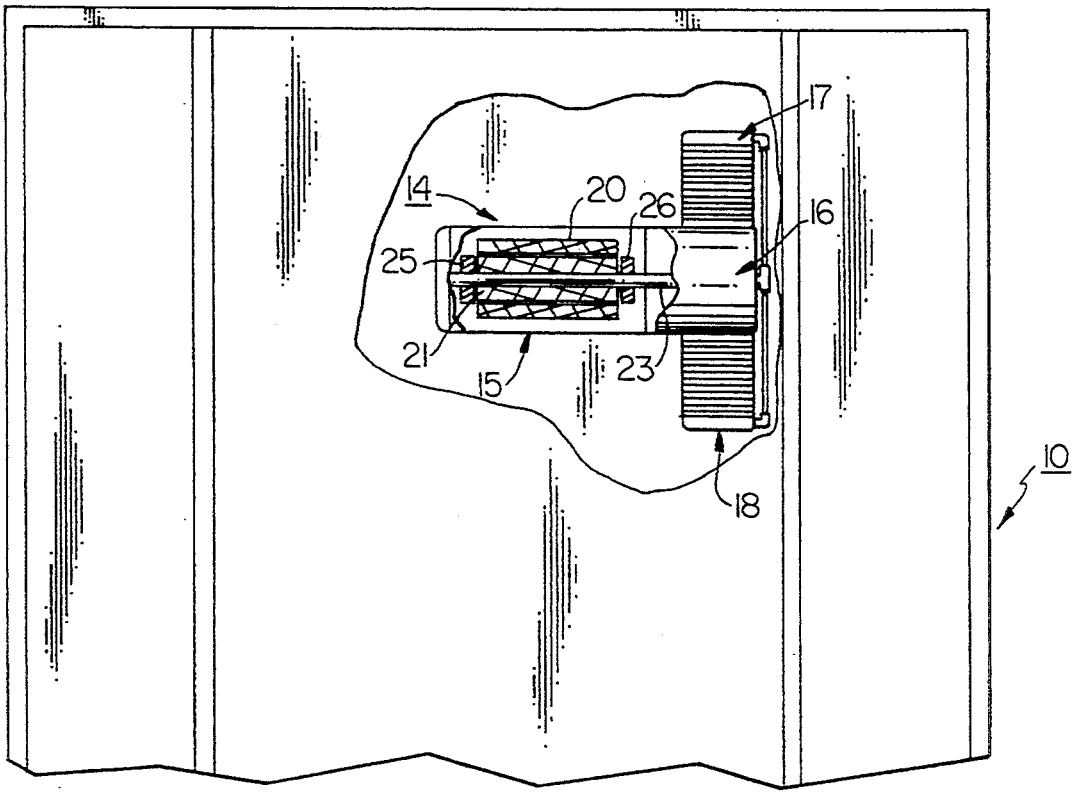
FIG. 1 is a end view of a cargo container with portions broken away showing a reciprocating air compressor mounted on the front vertical wall of the container.
Figure 2:
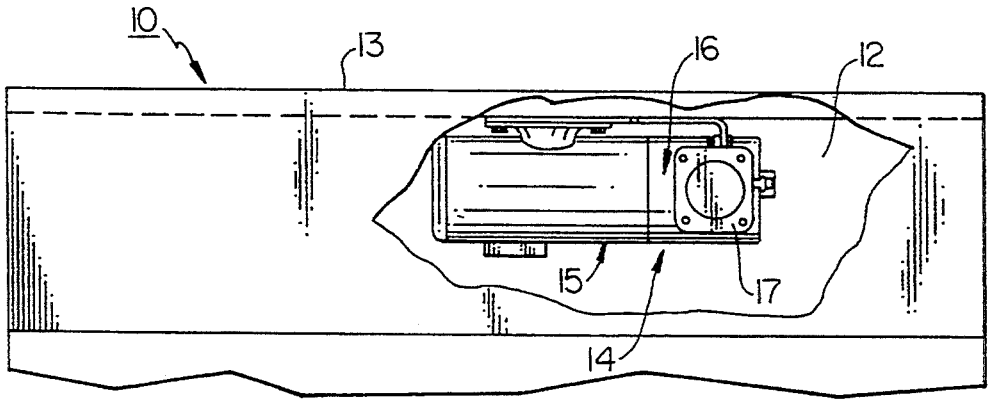
FIG. 2 is a top view of the cargo container illustrated in FIG. 1 with a portion broken away showing the air compressor mounted within the equipment compartment of the cargo container.

Turning now to the drawings and in particular to FIGS. 1 and 2, there is shown a cargo container generally referenced 10 of the type typically used to store perishable foods such as fruits, vegetables and the like. This type of container is generally moved by ship, rails or track over relatively long distances and as a consequence has its own independently operated air conditioning system (not shown) for controlling the climate inside the container. The climate support equipment is usually stored in a bay or compartment 12, (FIG. 2) located along the front wall 13 of the container. As noted above, this equipment consumes valuable container space and it is therefore important to minimize the amount of space that is needed by the equipment.

In this type of container it is the usual practice to replace the oxygen inside the container with nitrogen gas to help preserve the cargo during long trips. This is accomplished by an air handling system that includes an air compressor for raising the pressure of ambient or outside air. High pressure air discharged from the compressor is passed through a condenser and a series of filters to remove water and particulate material from the air stream. The clean air is then passed through a separator having a series of membranes for separating nitrogen gas from oxygen and other unwanted constituents. The oxygen and other lesser separated components are passed on to the atmosphere outside the container while the nitrogen is added to the atmosphere inside the container.

As in the case of the other air conditioning and climate control equipment, it is highly desirous to compact the nitrogen generating equipment as much as possible without sacrificing performance. The major space consuming component in the nitrogen generating system is the air compressor. As will be explained in greater detail below, the apparatus of the present invention involves a reciprocal air compressor that can be securely mounted on a vertical wall in the equipment compartment of a cargo container which utilizes a minimum amount of space without adversely effecting compressor performance.

As illustrated in FIGS. 1 and 2, the compressor 14 is hung high on the front wall 13 of the container and includes a motor housing 15, a crank case 16 and a pair of opposed piston cylinders 17 and 18 connected to the crank case. While two opposed cylinders are used in the preferred embodiment, the invention can be practiced with any number of cylinders. An electric motor is contained within the motor housing which includes a stator 20 and a rotor 21. The rotor is mounted upon a shaft 23 which in turn is supported by sealed bearings 25 and 26. The shaft is arranged to extend into the crank case and is connected to pistons that are slidably contained in the opposed cylinders by means of suitable piston rods (not shown). Outside air is drawn into the cylinders where it is compressed and then discharged from the compressor in the manner described in the previously noted patent to Olson.

Figure 3:
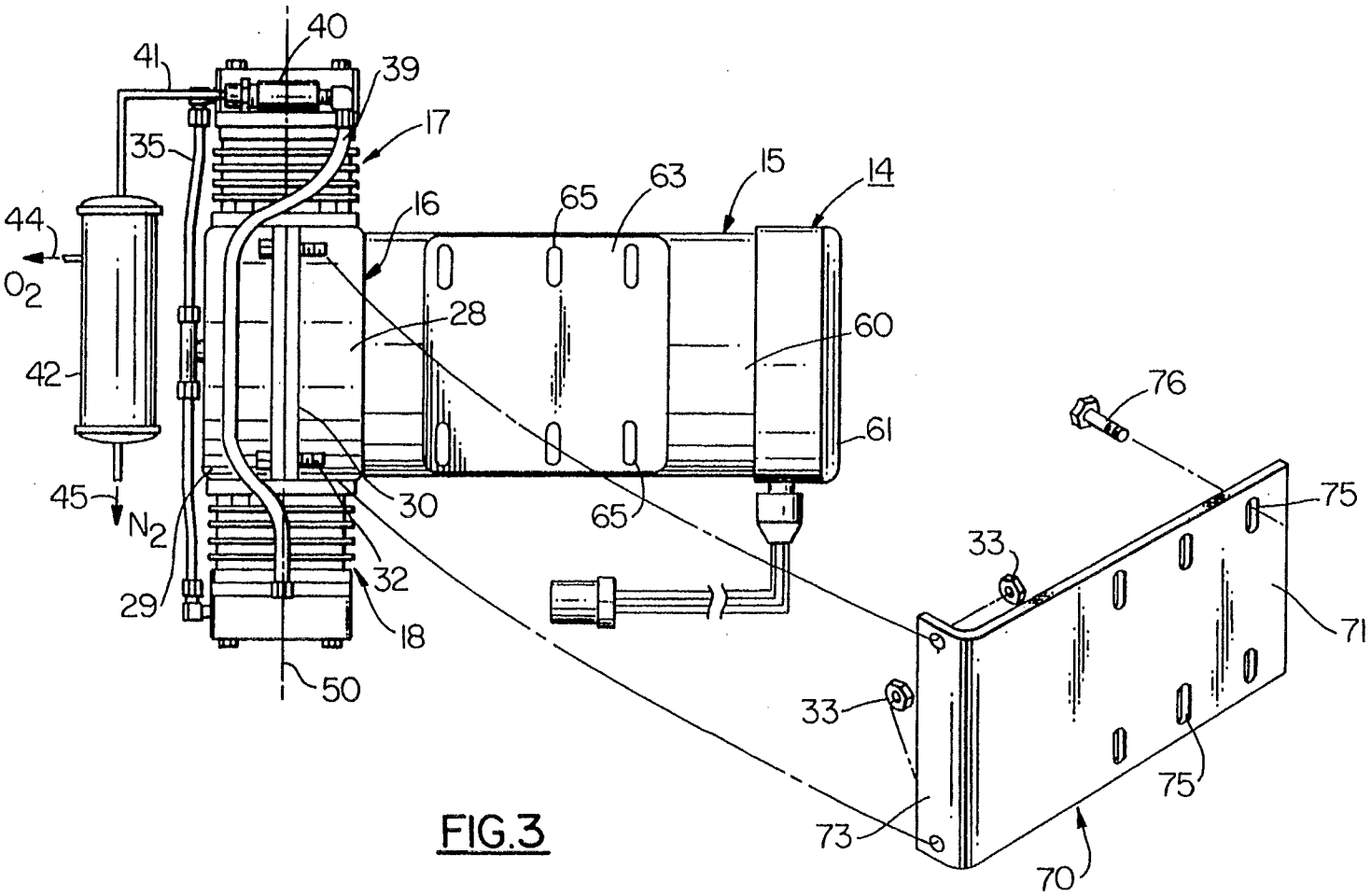
FIG. 3 is an enlarged side elevation showing a reciprocal air compressor embodying the teachings of the present invention.

As further illustrated in FIG. 3, the motor housing 15 includes a relatively thin walled cylindrical metal shell 27 that is joined at one end to the crank case 16. The crank case consists of two cast metal half sections 28 and 29 that are brought together by means of a bolting flange 30. The two half sections secured in assembly by means of bolts 32—32 and nuts 33—33 that are threaded thereon.

Suitable seals are contained within the compressor unit to prevent the working fluid from escaping from the compressor. The pistons contained within the cylinders also have sliding rings which to a large extent prevent air from being exchanged between the cylinders and the crank case. Any process air that might blow by the piston rings is conveyed back to the cylinders by means of a blowby line 35 and thus can not find its way into the container where it might adversely effect the nitrogen content in the container. The air compressed within the cylinders is delivered via line 39 into an air manifold 40 from which it is passed via discharge line 41 to a nitrogen separator 42. Although not shown, suitable condensing lines and particle filter may be operatively connected into the discharge line.

In the separator 42 oxygen and other lesser components are separated from the nitrogen gas. The oxygen and other unwanted components are exhausted to the surrounding ambient by line 44 and the nitrogen gas is delivered into the container via supply line 45.

The two opposed cylinders of the compressor are aligned along a common axis 50. It is important when mounting a reciprocal compressor of this type that the shaft of the motor be aligned in a horizontal plane. When the compressor is mounted in this position, the shaft bearings will be placed almost entirely under a radial load which they are well able to accept. Tilting the centerline of the motor shaft away from the horizontal plane will produce a thrust loading in the bearings which they are not well able to resist, thereby leading to early compressor failure. As can be seen, due to bearing considerations, care must be taken to properly mount the compressor on the vertical wall of a cargo container.

The motor housing of the compressor is formed of a cylindrical sheet metal tube 60 closed at the distal end by means of an end cap 61. A flat plate 63 is typically spot welded to the housing so that the plate is situated in a plane that is parallel to the axis 50 of the cylinders. The plate 63 is provided with a series of slotted holes 65—65.

In assembly, the plate is positioned in tangential contact against the surface of the motor housing. As noted above, the proximal end of the housing is secured and sealed in the crank case 16. The two half sections of the crank case are cast from a suitable metal and are bolted together in assembly along the bolting flange 30. The cast metal crank case, which is relatively stronger than the motor housing, in a sense forms the structural hub or backbone of the compressor. The crank case is manufactured of cast aluminum, which is thicker than the sheet metal of the motor housing. In the preferred embodiment the motor housing is 90 mil steel sheet metal, and the crank case has a cast aluminum shell that is about 400 mil thick. As will be seen from the disclosure below, the strength of the crank case is used as the basis for securely affixing the compressor to the vertical inner wall of the cargo container so that the mounted compressor is well able to withstand the stress induced therein due to rough handling as the container is loaded and unloaded from a carrier.

An L-shaped bracket 70 is used to affix the compressor to the vertical front wall of the container. The bracket includes a flat base 71 and an upwardly turned arm 73. The base has a series of slotted holes 75—75 that align with holes formed in plate 63. The base and the plate are placed in face to face relationship in assembly and threaded fasteners 75 are passed through the aligned holes to secure the compressor to the inner wall of the cargo container. In addition, arm 73 of the bracket has a pair of holes 78—78 that are adapted to fall in alignment with the bolt holes in the bolting flange 30 on the crank case. Bolts 32—32 are arranged to pass through the flange and the holes in the bracket arm and the bracket is secured to the flange and thus the crank case by threading nuts 33—33 onto the bolts.

As can be seen the mounting bracket is thus secured to both the motor housing and the stronger crank case structure. According, an extremely secure mounting for the compressor is achieved when the bracket is affixed to the container wall. Enough tolerance is provided in the elongated mounting holes of the bracket to allow the compressor shaft to be accurately aligned in a horizontal plane on the wall. Because the motor housing plate 63 is in tangential contact against the motor housing the cylinders of the housing can be placed in close proximity to and adjacent with the wall surface. In light of the fact that the compressor is exposed to the climatic conditions within the cargo containers, the compressor does not require additional cooling and therefore bulky space consuming fans can be eliminated from the compressor design. The net result is a compact low profile compressor that can be securely mounted upon the vertical wall of a cargo container in a position that minimizes thrust loading of the compressor shaft bearings.

While this invention has been described in detail with reference to a certain preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. An oilless reciprocating air compressor for use inside an air conditioned cargo container that includes a motor housing containing a stator and a shaft mounted rotor, said shaft being rotatably supported upon sealed bearings, a high strength crank case secured to one end of said motor housing with one end of said shaft extending into said crank case, at least one cylinder mounted upon the crank case, and containing piston means connected to the shaft by rod means, a plate mounted on said motor housing, said plate being parallel to the axis of said cylinder, a bracket means having a base leg secured to said plate and an arm secured to said crank case, and fastening means for securing the base leg of said bracket means to a vertical inside wall of the cargo container with the shaft being horizontally disposed and the cylinder being vertically disposed adjacent said wall.

2. The compressor according to claim 1, wherein said cylinder comprises a pair of opposed cylinders, said cylinders being coaligned along a common axis.

3. The compressor according to claim 1, wherein said cylinder comprises a plurality of cylinders.

4. The air compressed of claim 1 wherein said crank case includes a bolting flange and the arm of said bracket means is attached to the bolting flange by threaded means.

5. The air compressor of claim 1 that further includes a bypass line for placing the crank case in fluid flow communication with the cylinder.

6. The air compressor of claim 1 wherein the external surfaces of the cylinder include cooling fins whereby the cylinder is cooled by conditioned air contained inside said cargo container.

7. The air compressor of claim 1 wherein said motor housing is cylindrically shaped and said plate is mounted in tangential contact against the motor housing.

8. The air compressor of claim 1 wherein the crank case has greater load carrying capacity than the motor housing.

9. The air compressor of claim 6 wherein both the crank case and the motor housing are formed of metal.

10. The air compressor of claim 1 wherein said compressor further includes a discharge line for exhausting high pressure air from said cylinder and membrane means for extracting nitrogen gas from the high pressure air and delivering said nitrogen gas into said cargo container.

11. A method for using an oilless reciprocating air compressor inside an air conditioned cargo container, the compressor being of the type that includes:

a motor housing containing a stator and a shaft mounted rotor, said shaft being rotatably supported upon sealed bearings;

a high strength crank case secured to one end of said motor housing with one end of said shaft extending into said crank case; and a pair of opposed cylinders mounted upon the crank case, said cylinders being coaligned along a common axis and containing piston means connected to the shaft by rod means;

the method comprising the steps of:

mounting a plate on said motor housing, said plate being parallel to the axis of said cylinders;

securing said plate to an arm portion of a bracket, and securing a base leg portion of said bracket to the crank case of the motor housing, to securely hold the motor housing in said bracket; and securing the bracket to a vertical inside wall of the cargo container with the shaft being horizontally disposed and the cylinders being vertically disposed adjacent said wall.

* * * * *

UNITED STATES PATENT AND TRADEMARK OFFICE

CERTIFICATE OF CORRECTION

PATENT NO. : 5,419,688

DATED : May 30, 1995

INVENTOR(S) : Basinski et al.

It is certified that error appears in the above-identified patent and that said Letters Patent is hereby corrected as shown below:

On the title page, Item [73] should read:

-- [73] Assignees: Carrier Corporation, Syracuse, NY and Thomas Industries, Incorporated, Monroe, LA --

Signed and Sealed this

Twenty-third Day of January, 1996

*Attest:*

Bruce Lehman

BRUCE LEHMAN

*Attesting Officer*

*Commissioner of Patents and Trademarks*